US010760393B2

(12) United States Patent
Slater

(10) Patent No.: US 10,760,393 B2
(45) Date of Patent: Sep. 1, 2020

(54) CLEANING SAGD EQUIPMENT WITH SUPERCRITICAL CO2

(71) Applicant: CONOCOPHILLIPS COMPANY, Houston, TX (US)

(72) Inventor: Peter N. Slater, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 46 days.

(21) Appl. No.: 15/978,925

(22) Filed: May 14, 2018

(65) Prior Publication Data

US 2018/0328156 A1 Nov. 15, 2018

Related U.S. Application Data

(60) Provisional application No. 62/505,160, filed on May 12, 2017.

(51) Int. Cl.

| | |
|---|---|
| ***E21B 43/24*** | (2006.01) |
| ***E21B 43/34*** | (2006.01) |
| ***E21B 37/06*** | (2006.01) |

(52) U.S. Cl.

CPC ..... *E21B 43/2408* (2013.01); *E21B 37/06* (2013.01); *E21B 43/34* (2013.01)

(58) Field of Classification Search

CPC ..... E21B 43/2408
USPC ..... 166/50
See application file for complete search history.

(56) References Cited

U.S. PATENT DOCUMENTS

| | | | | |
|---|---|---|---|---|
| 5,013,366 | A * | 5/1991 | Jackson | C23G 5/00 134/1 |
| 2013/0213652 | A1* | 8/2013 | Stalder | E21B 43/2406 166/272.3 |
| 2016/0214878 | A1* | 7/2016 | Weimer | C02F 1/20 |
| 2016/0244346 | A1* | 8/2016 | Bernar | E21B 43/24 |
| 2017/0051597 | A1* | 2/2017 | Akiya | C10G 33/04 |
| 2018/0021697 | A1* | 1/2018 | Harvey | E21B 21/063 210/708 |

* cited by examiner

*Primary Examiner* — Taras P Bemko
(74) *Attorney, Agent, or Firm* — Boulware & Valoir

(57) ABSTRACT

Steam assisted gravity drainage (SAGD) equipment including steam generating equipment may be cleaned using supercritical carbon dioxide. Supercritical carbon dioxide is a fluid state of carbon dioxide where it is held at or above its critical temperature and critical pressure. Supercritical carbon dioxide has exceptional solvent qualities that can dissolve, soften, or dislodge the refractory fouling deposits in the SAGD equipment.

8 Claims, 3 Drawing Sheets

CLEANING SAGD EQUIPMENT WITH SUPERCRITICAL CO2

PRIOR RELATED APPLICATIONS

This application is a non-provisional application which claims benefit under 35 USC § 119(e) to U.S. Provisional Application Ser. No. 62/505,160 filed May 12, 2017, entitled "CLEANING SAGD EQUIPMENT WITH SUPERCRITICAL CO2," which is incorporated herein in its entirety.

FIELD OF THE DISCLOSURE

The invention relates to treatment methods to clean SAGD equipment, particularly steam generation equipment from oil fields.

BACKGROUND OF THE DISCLOSURE

The effective production of hydrocarbon reservoirs containing heavy oils or unconventional oils presents significant challenges. Extraction of these high viscosity hydrocarbons is difficult due to their relative immobility at reservoir temperature and pressure. These properties make it difficult to simply pump the unconventional oil out of the ground. Such hydrocarbons may be quite thick and have a consistency similar to that of peanut butter or heavy tars, making their extraction from reservoirs difficult.

Enhanced oil recovery or "EOR" processes employ thermal methods to improve the recovery of heavy oils from sub-surface reservoirs. The injection of steam into heavy oil bearing formations is a widely practiced enhanced oil recovery method. Typically, several metric tons of steam are required for each metric ton of oil recovered.

Traditionally, heavy oil recovery operations have utilized "once through" type steam generators also known herein as "Once Through Steam Generators (OTSGs). The steam or a steam-water mixture is injected via injection wells to fluidize the heavy oil. Different percentages of water and steam can be injected into the injection wells, depending on a variety of factors including the expected output of oil and the economics of injecting different water/steam mixtures.

Injected steam heats the oil in the reservoir, which reduces the viscosity of the oil and allows the oil to flow to a collection well. After the steam fully condenses and mixes with the oil, and is then produced, it is classified as "produced water." The mixture of oil and produced water that flows to the production well is pumped to the surface. Oil is then separated from the produced water by conventional processes employed in conventional oil recovery operations.

There are many steam-based methods of enhanced oil recovery, but two important ones are cyclic steam stimulation or "CSS", which uses vertical wells, and steam assisted gravity draining or "SAGD", which uses a horizontal well pair. SAGD has come to be widely used in oil sands and there are also many variations on these methods.

For economic and environmental reasons, it is desirable to recycle produced water as much as possible. The produced water stream, after separation from the oil, is further de-oiled, and is treated for reuse. Most commonly, the water is sent to the "once-through" steam generators for creation of more steam for oil recovery operations. However, the reuse of water contributes significantly to build up of deposits in the OTSG and other steam handling equipment.

The tubes in OTSG's and downstream exchangers which cool steam and OTSG blowdown frequently foul with refractory deposits composed of both carbon and inorganic constituents. Pigging is a viable, but expensive, method for dealing with OTSG deposits. However, mechanical cleaning of some of the downstream exchangers is exceptionally difficult and expensive because of the high temperature, high pressure design features. Therefore, what is needed in the art is a means of chemically cleaning this equipment. At least one chemical vendor has proposed a chemical cleaning regimen using acidic and basic chemicals, but these chemicals pose corrosion, handling, and disposal risks.

Many attempts have been made to overcome these issues, but there still exists a need for a quick and cost effect means of cleaning steam and other SAGD equipment. Ideally, the treatment will not require expensive equipment or treatment systems, require large amounts of chemicals, increase energy consumption, or waste energy.

SUMMARY OF THE DISCLOSURE

The present disclosure describes a system and method for cleaning SAGD equipment using supercritical CO2.

The tubes in OTSG's and downstream exchangers that cool steam and OTSG blowdown frequently foul with refractory deposits composed of both carbon and inorganic constituents. Pigging is a viable, but expensive method for dealing with OTSG deposits. However, mechanical cleaning of some of the downstream exchangers is exceptionally difficult and expensive because of the high temperature, high pressure design features.

At least one chemical vendor has proposed a chemical cleaning regimen using acidic and basic chemicals, which pose corrosion, handling, and disposal risks. Thus, we sought a means of chemically cleaning this equipment that did not use hazardous chemicals.

Supercritical carbon dioxide (sCO2) is a fluid state of carbon dioxide where it is held at or above its critical temperature and critical pressure. See FIG. 1. Carbon dioxide usually behaves as a gas in air at standard temperature and pressure (STP), or as a solid called dry ice when frozen. If the temperature and pressure are both increased from STP to be at or above the critical point for carbon dioxide, it can adopt properties midway between a gas and a liquid. More specifically, it behaves as a supercritical fluid above its critical temperature (304.25 K, 31.10° C., 87.98° F.) and critical pressure (72.9 atm, 7.39 MPa, 1,071 psi), expanding to fill its container like a gas but with a density like that of a liquid.

Supercritical CO2 is becoming an important commercial and industrial solvent due to its role in chemical extraction, in addition to its low toxicity and low environmental impact. The relatively low temperature of the process and the stability of CO2 also allows most compounds to be extracted with little damage or denaturing. In addition, the solubility of many extracted compounds in CO2 varies with pressure, permitting selective extractions.

Thus, supercritical CO2 or "sCO2" has exceptional solvent qualities that can dissolve, soften, or dislodge the refractory fouling deposits in the SAGD equipment. Since the critical point of carbon dioxide (~90° F., 1071 psia) is well below the design specs of the target equipment, the equipment can easily tolerate passage of supercritical CO2 for a period long enough to remove the deposits. Once the soak time has elapsed, the equipment can be depressurized through a receiving vessel to blow out the CO2 and loosened deposits. As the CO2 flashes to atmospheric conditions, any dissolved material will precipitate. The CO2 can be captured and compressed for reuse. In fact, the sCO2 can be generated at or near the well pad.

Supercritical CO2 is chemically stable, reliable, low-cost, non-toxic, non-flammable and readily available, making it a desirable candidate working fluid. CO2 can be extracted from air, using a CO2 extractor, and then pressurized to make sCO2.

Supercritical CO2 is well-known as a cleaning agent for removing soils from small equipment and components, but has heretofore never been applied at a wellpad to clean SAGD equipment. In prior art applications, the articles to be cleaned were immersed in a bath of supercritical CO2. In the present invention, by contrast, the articles to be cleaned will be large industrial equipment that will comprise the container for the CO2. The equipment to be cleaned will be taken offline and connected to a source of CO2 and a compression apparatus for generating sCO2, as well as equipment for receiving the spent CO2 and the fouling material that is removed. The cleaning will thus proceed without using any harsh or toxic chemicals which could potentially corrode the equipment or pose a health, safety, or environmental (HSE) risk or any disposal issues. The foulant will end up as a dry solid ready for easy disposal. All of the cleaning steps can take place at conditions well below the equipment's operating limits and will rely on heat already provided by the equipment.

This summary is provided to introduce a selection of concepts that are further described below in the detailed description. This summary is not intended to identify key or essential features of the claimed subject matter, nor is it intended to be used as an aid in limiting the scope of the claimed subject matter.

By "SAGD" herein we mean any of the varying steam assisted gravity drainage methods that use both steam and gravity at least in part to mobilize and collect oil, including expanding solvent SAGD, gas push SAGD, RF assisted SAGD, single well SAGD, cross SAGD, fishbone SAGD, radial fishbone SAGD, and the like.

As used herein, "foulants" includes any of the solid material that is removed from a steam generating system, including all of the piping, by the sCO2 as described herein.

As used herein, a "steam generator" or "steam generator system" includes all of the equipment needed to generate steam for use in EOR, and includes the various piping, valves, sensors and controls, etc. needed to make such as system functional.

As used herein, "spent sCO2" means the CO2 existing the system after cleaning, which may be mostly gaseous CO2, but some sCO2 may be present, plus any foulants removed during the traversal of the dirty steam generation system.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| OTSG | Once-through steam generator |
| HSE | Health, Safety, Environment |
| SAGD | Steam assisted gravity drainage |
| KO drum | Knock out drum |
| ATM | Atmosphere |
| EOR | Enhanced oil recovery |

DETAILED DESCRIPTION OF THE DISCLOSURE

A novel system and method for cleaning SAGD and other EOR equipment, especially steam generation, feedwater cleaning, and delivery equipment is described.

Figure 1:
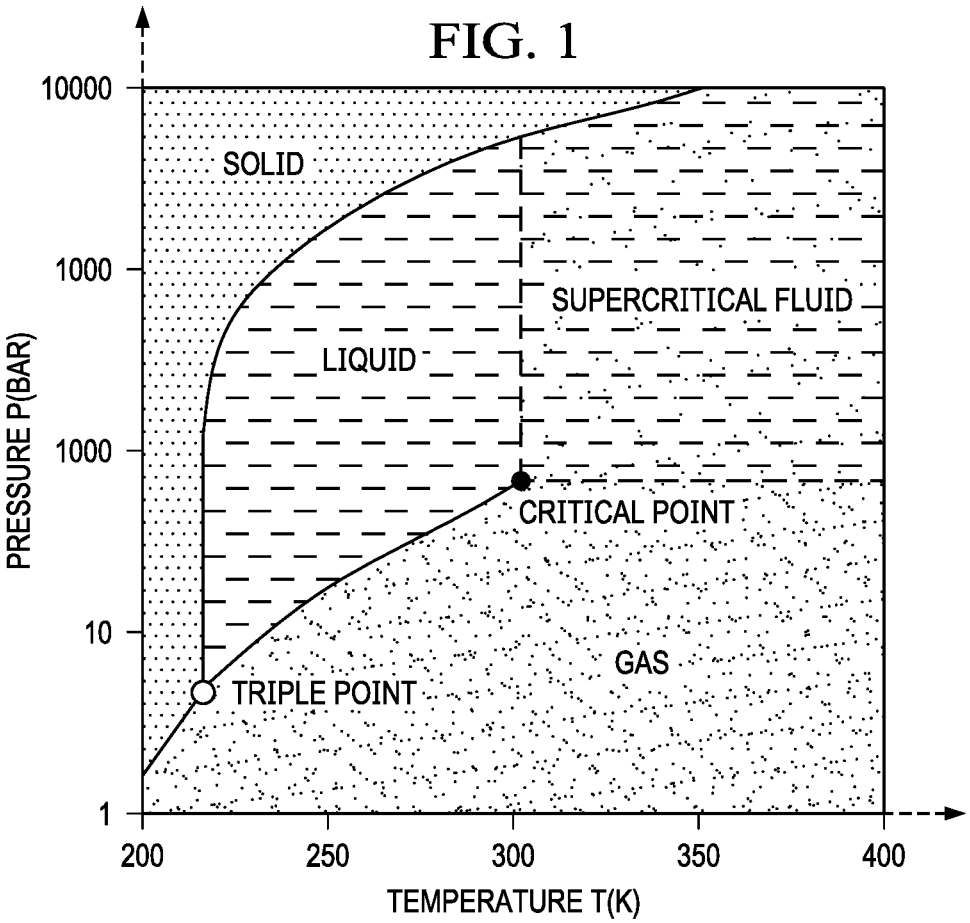
FIG. 1. Carbon dioxide pressure-temperature phase diagram.
Figure 2:
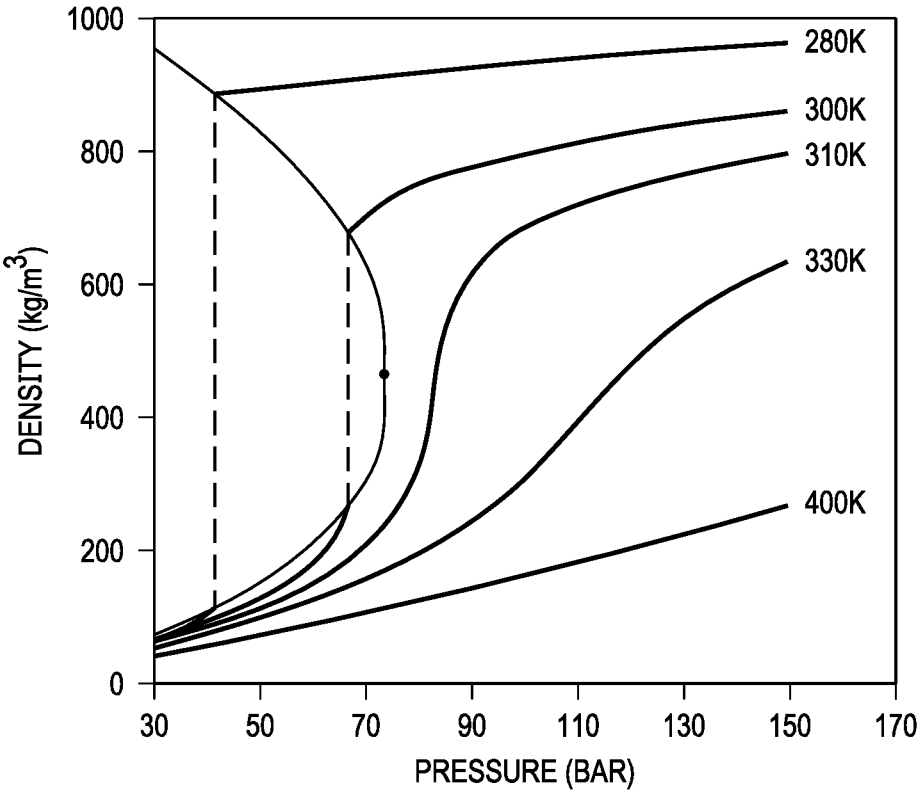
FIG. 2. Carbon dioxide density-pressure phase diagram.

FIG. 1 and FIG. 2 show projections of a CO2 phase diagram. In the pressure-temperature phase diagram (FIG. 1) the boiling separates the gas and liquid region and ends in the critical point, where the liquid and gas phases disappear to become a single supercritical phase. This can be observed in the density-pressure phase diagram for carbon dioxide, as shown in FIG. 2. At well below the critical temperature, e.g., 280 K, as the pressure increases, the gas compresses and eventually (at just over 40 bar) condenses into a much denser liquid, resulting in the discontinuity in the line (vertical dotted line). The system consists of 2 phases in equilibrium, a dense liquid and a low density gas. As the critical temperature is approached (300 K), the density of the gas at equilibrium becomes higher, and that of the liquid lower. At the critical point, (304.1 K and 7.38 MPa (73.8 bar)), there is no difference in density, and the 2 phases become one fluid phase.

Thus, above the critical temperature a gas cannot be liquefied by pressure. At slightly above the critical temperature (310 K), in the vicinity of the critical pressure, the line is almost vertical. A small increase in pressure causes a large increase in the density of the supercritical phase. Many other physical properties also show large gradients with pressure near the critical point, e.g. viscosity, the relative permittivity and the solvent strength, which are all closely related to the density. At higher temperatures, the fluid starts to behave like a gas, as can be seen in FIG. 2. For carbon dioxide at 400 K, the density increases almost linearly with pressure.

Figure 3:
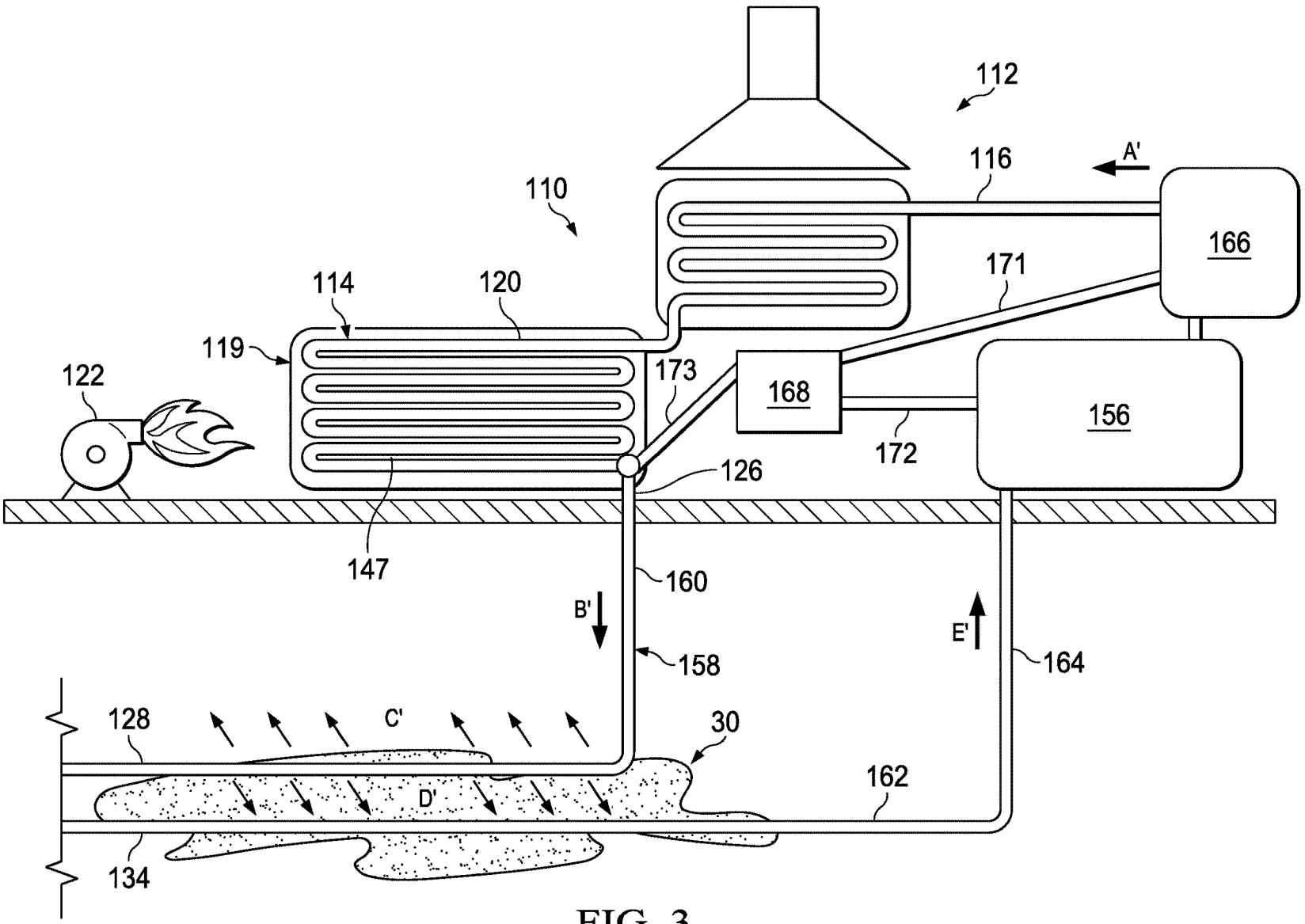
FIG. 3 is a schematic illustration of a SAGD system of the invention.

Reference is first made to FIG. 3 to describe an embodiment of a system 112 for extracting crude oil from oil-bearing ground 30 and for cleaning steam-generating equipment. The system 112 preferably includes one or more once-through steam generators or "OTSG" 110, each having one or more steam-generating circuits 114 extending between inlet and outlet ends 116, 126, and including one or more pipes 120. Each steam-generating circuit 114 includes a heating segment 147 thereof positioned to at least partially define a heating portion 119 of the once-through steam generator 110. The OTSG 110 includes one or more heat sources 122 for generating heat to which the heating segment 147 is subjected.

Preferably, the steam-generating circuit 114 is adapted to receive feedwater at the inlet end 116, the feedwater being moved toward the outlet and being subjected to the heat from the heat source to convert the feedwater into wet steam (i.e., steam and water). As will be described, the concentrations of the impurities in the water increase as the water approaches the outlet end 126, due to evaporation of at least part of the water. The feedwater also includes substantial initial concentrations of impurities.

In one embodiment, the system 112 preferably also includes a water treatment means 156 for producing the feedwater. Preferably, the system 112 also includes a first ground pipe subassembly 158 in fluid communication with the steam-generating circuit 114 via the outlet end 126 thereof. In one embodiment, the first ground pipe subassembly 158 preferably includes a distribution portion 128 for distributing the steam in the oil-bearing ground 30, and a first connection portion 160, for connecting the distribution portion 128 and the steam-generating circuit 114. It is also preferred that the system 112 includes a second ground pipe subassembly 162 with a collection portion 134 for collection of an oil-water mixture from the reservoir.

The oil-water mixture is a mixture of the crude oil from the oil-bearing ground and condensed water resulting from condensation of the steam in the ground. Preferably, the collection portion 134 is in fluid communication with the water treatment means 156 via a connection pipe 164, so that the oil-water mixture is supplied to the water treatment means 156 from the second ground pipe subassembly 162. In one embodiment, the water treatment means 156 preferably is adapted to produce the feedwater from the oil-water mixture, which then feeds into the OTSG (arrow at A).

Fouling of heat transfer surfaces presents an ongoing challenge to steam plants used for EOR. SAGD produced water, for example, contains significant concentrations of dissolved solids, as well as suspended clays, free oil, and dissolved organics. Under certain conditions of temperature, pressure and velocity, these compounds will cause fouling in heat exchanger and steam generator tubes. This leads to the need for complex water treatment in conjunction with frequent downtime for cleaning and maintenance of equipment. Hence, fouling of these surfaces leads to additional operating costs and lost production for the SAGD sector. Instead of pigging or using harsh chemicals, we have included sCO2 generators in the steam plant design to allow periodic cleaning of surfaces with sCO2.

$sCO_2$ is produced in pressurizer 166, which can also comprise a $CO_2$ extractor, and fed into the steam system during a scheduled shut down and cleaning session, Once the supercritical $CO_2$ passes through the various heat exchangers, picking up material from the walls of the heat exchangers, it is routed through line 173 to knockout drum 168, where solids are left behind. Any means of separating the solids from the $CO_2$ can be used, but one simple method is to simply flash the $CO_2$ into a gas, leaving the solids to fall out.

CO2 is recovered via line 171 for reuse in pressurizer 166, if desired, and water, if any, is routed back to separator 165 though line 172. The CO2 can be extracted from the air and be part of or adjacent or contiguous with the CO2 pressurizer. Alternatively, the CO2 extractor can be separate (not shown). CO2 can be extracted from the air, or from the produced oil/water mixture, depending on the type of EOR being used, e.g., if gas push is used, it may be feasible to extract some amount of CO2 from the produced fluid.

As indicated above, SAGD is only one example of an enhanced oil recovery process involving steam. Many other such processes are known. From the foregoing, however, it will be appreciated that steam quality is an important parameter in connection with the profitability of a particular enhanced oil recovery system, and cleaning the systems contributes both to steam quality as well as saving energy, plus faster cleaning saves down time.

We will test the methodology in the field using high pressure, high temperature exchangers, which are candidates for the sCO2 based method. Mechanical cleaning of these exchangers is estimated to require two weeks of downtime each and substantial labor. We predict that the cleaning with sCO2 by contrast can occur in as little as 2-3 days. We also have several OTSG's which could be candidates for sCO2 cleaning.

The disclosed system and methods comprises one or more of the following embodiments, in any combination thereof:

In one embodiment, a heavy oil steam generation system has an outlet fluidly connected to an injection well for injecting steam into a reservoir; the steam generator system having a feedwater inlet for receiving a feedwater to be converted to steam; the steam generator system also has a second inlet for receiving a supercritical CO2 (sCO2) from a sCO2 generator; and a second outlet fluidly connected to a container for receiving foulants and spent sCO2 exiting from the steam generator system.

In another embodiment, a system for producing heavy oil with steam, has: a steam generator with a first fluidic circuit receiving boiler feedwater from a water treatment system that generates steam for an injection well for injecting steam into a reservoir and a second fluidic circuit from a supercritical CO2 generator (sCO2) for injecting sCO2 into said steam generator and to a flash drum for accepting spent sCO2 and foulants after said sCO2 has traversed said steam generator; a production well in said reservoir that is in fluid communication with the injection well, said production well fluidly connected to a separator for separating produced fluids into a heavy oil and a produced water; and the separator is fluidly connected to a water treatment system for cleaning the produced water to make boiler feedwater, said boiler feedwater feeding into the first fluidic circuit of the steam generator.

An improved steam generating system for steam-based enhanced oil recovery, is described where the steam generating system has a steam generator fluidly connected to one or more wells for a steam based enhanced oil recovery, the improvement comprising adding a second fluidic circuit to the steam generator for injecting sCO2 into the steam generator and for collecting removed foulants and spent sCO2 on exiting the steam generator.

Additionally, an improved once through steam generating (OTSG) system for SAGD is described where the OTSG system comprising an OTSG fluidly connected to one or more injection wells for SAGD, each injection well above and parallel to a lower production well, the improvement comprising an added inlet to said OTSG system for receiving sCO2 from a sCO2 generator and an added outlet fluidly connected to a container for accepting for foulants and spent sCO2 exiting the OTSG system.

A flash drum may be connected to the sCO2 generator for recycling used CO2.

The injection well and the production well may be horizontal well pairs. The injection well may be 3-10 m above said production well for steam assisted gravity drainage (SAGD) to produce said heavy oil.

The injection well and said production well may be horizontal well pairs used for SAGD or a SAGD variation to produce said heavy oil.

Alternatively, the injection well and said production well may be vertical wells and cyclic steam stimulation may be used to produce said heavy oil.

The present invention is exemplified with respect to SAGD. However, this is exemplary only, and the system can be broadly applied to other oil production equipment that tends to degrade due to foulant buildup.

The invention claimed is:

1. A steam generation system for producing heavy oil with steam, comprising:

a) a steam generator system having a feedwater inlet for receiving a feedwater to be converted to steam;

b) said steam generator system having an outlet fluidly connected to an injection well for injecting steam into a reservoir, said injection well fluidly connected to a production well;

c) said steam generator system having a second inlet for receiving a supercritical $CO_2$ ($sCO_2$) from a $sCO_2$ generator at a first pressure; and d) said steam generator system having a second outlet fluidly connected to a container at a second pressure for receiving foulants and spent $sCO_2$ exiting from said steam generator system;

e) said second pressure being lower than said first pressure such that said spent $sCO_2$ flashes to a $CO_2$ gas and said foulants precipitate as solids in said container.

2. The system of claim 1, wherein said injection well and said production well are horizontal well pairs and the injection well is 3-10 m above said production well and steam assisted gravity drainage (SAGD) is used to produce said heavy oil.

3. The system of claim 1, wherein said injection well and said production well are horizontal well pairs and where SAGD or a SAGD variation is used to produce said heavy oil.

4. The system of claim 1, wherein said injection well and said production well are vertical wells and cyclic steam stimulation is used to produce said heavy oil.

5. A system for producing heavy oil with steam, comprising:

a) a steam generator having first fluidic circuit from a water treatment system for receiving a boiler feedwater from said water treatment system and to an injection well for injecting steam into a reservoir;

b) said steam generator having a second fluidic circuit from a supercritical $CO_2$ generator ($sCO_2$) for injecting $sCO_2$ into said steam generator and to a flash drum for accepting spent $sCO_2$ flashed to $CO_2$ gas and solid foulants after said $sCO_2$ has traversed said steam generator, said flash drum fluidly connected to said $sCO_2$ generator for recycling used $CO_2$;

c) a production well in said reservoir and in fluid communication with said injection well, said production well fluidly connected to a separator for separating produced fluids into a heavy oil and a produced water; and d) said separator fluidly connected to said water treatment system for cleaning said produced water to make boiler feedwater, said boiler feedwater feeding into said first fluidic circuit.

6. The system of claim 5, wherein said injection well and said production well are horizontal well pairs and the injection well is 3-10 m above said production well and steam assisted gravity drainage (SAGD) is used to produce said heavy oil.

7. The system of claim 5, wherein said injection well and said production well are horizontal well pairs and where SAGD or a SAGD variation is used to produce said heavy oil.

8. The system of claim 5, wherein said injection well and said production well are vertical wells and cyclic steam stimulation is used to produce said heavy oil.

* * * * *